United States Patent [19]

Van Meter

[11] Patent Number: 5,062,974

[45] Date of Patent: Nov. 5, 1991

[54] MUNITIONS LUBRICANT AND PROTECTOR

[75] Inventor: Keith E. Van Meter, West Palm Beach, Fla.

[73] Assignee: Lighthouse Manufacturing Co., Inc., West Palm Beach, Fla.

[21] Appl. No.: 370,456

[22] Filed: Jun. 23, 1989

[51] Int. Cl.[5] ..... C10M 125/22

[52] U.S. Cl. ..... 252/11; 252/25; 252/58; 102/511

[58] Field of Search ..... 252/11, 25, 58; 102/511

[56] References Cited

U.S. PATENT DOCUMENTS

| | | | |
|---|---|---|---|
| 3,496,003 | 2/1970 | Simon-Vermot | 252/25 |
| 4,196,670 | 4/1980 | Vatsvoz | 102/511 |
| 4,239,006 | 12/1980 | Kelson | 102/511 |
| 4,333,840 | 6/1982 | Reick | 252/58 |
| 4,454,175 | 6/1984 | Martin | 102/511 |

FOREIGN PATENT DOCUMENTS

| | | | |
|---|---|---|---|
| 1145297 | 7/1986 | Japan | 252/11 |

*Primary Examiner*—Jacqueline V. Howard
*Attorney, Agent, or Firm*—Harry W. Barron

[57] ABSTRACT

A composition for surface treatment of firearms and bullets provide a corrosion resistance and dry lubrication. It comprises an admixture of finely divided molybdenum disulfide and sodium molybdate in an organic solvent.

6 Claims, No Drawings

MUNITIONS LUBRICANT AND PROTECTOR

BACKGROUND OF THE INVENTION

Field of the Invention

The present invention relates to protective and lubricating coatings for metals and more particularly to compositions for applying a dry protective and lubricating surface coating to firearms and ammunition.

It has long been recognized that bullets frictionally engage the bore of the firearm through which they are fired. This heats the barrel. Small surface defects in the barrel increase frictional forces and remove particles of the bullet. The lead or copper deposits build up in the barrel and impair ballistic operation of the weapon. The problem has been addressed by many inventors and various lubricants including waxes, greases, soaps have been applied to the bullet and the firearm with varying degrees of success. Oils and greases have the added advantage of corrosion inhibition when applied to the weapon.

One problem with oils and greases is that they tend to collect and hold foreign matter including abrasive dust that is especially harmful to the weapon. Coatings that include organic matter such as waxes and resins may leave behind harmful products from the breakdown of the organic matter at the extreme temperature and pressure encountered.

It is well established in the art of lubricants that molybdenum disulfide is a most effective dry lubricant that is resistant to high temperature and pressure.

Martin in U.S. Pat. No. 4,454,175 issued 6/24/84 teaches that in order to effectively coat metal surfaces with molybdenum disulfide without an organic binder, the bullets must be tumbled for hours with the powder, steel shot and fibrous matter which gradually burnishes a thin, adherent coating of the molybdenum sulfide on the bullets.

Vatsvog in U.S. Pat. No. 4,196,670 issued 4/8/80 teaches the use of a synthetic resin dissolved in an organic solvent in which the molybdenum disulfide is suspended. When a bullet is coated, the solvent evaporates and the resin holds the molybdenum disulfide on the surface.

Gregg in U.S. Pat. No. 4,731,189 issued 3/15/88 teaches a coating and method combining molybdenum disulfide, petroleum and silicone oils, metallic soap greases, graphite and beeswax.

A composition that will protect the metal parts of a weapon, that will prevent build up of materials wiped off the bullet, that will provide lubrication in the harsh environment of the firing of the weapon and that will not itself leave harmful deposits is not known to be characterized by the compositions of the prior art.

SUMMARY OF THE INVENTION

It is accordingly an object of the invention to provide a compostion for surface treatment of weapons and projectiles therefor that is easily applied, that is stable and lubricating at high temperatures and pressures, that it dry after application to prevent collection of foreign matter, that does not require organic binders and that coats the surface to prevent corrosion and accumulation of metal deposits from the projectile, to ensure ballistic speed and accuracy.

The compostion of the invention comprises colloidal molybdenum disulfide suspended in a sodium molybdate solution with a non-aqueous, volatile solvent. The sodium molybdate forms a protective corrosion resistant coating on the metal surface and the molybdenum disulfide adheres tenaciously to the sodium molybdate to present a lubricous surface for dry lubrication of working parts of the weapon and also for the special environment of the bore of the firearm or coating of the projectile. There are distinct advantages to having a single composition for treating all the surfaces of the weapon.

In the following illustration I describe a typical composition and quantities which, of course, may be varied to obtain somewhat varying results utilizing the same basic principles.

DETAILED DESCRIPTION OF PREFERRED EMBODIMENT

The composition may be formulated from molybdenum disulfide powder having particle sizes of 0.5 to 5.0 microns. 0.6 weight percent of this molybdenum disulfide is suspended in 1,1,1 trichloroethane solvent containing 0.1 weight percent of sodium molybdate dihydrate. The composition is stable although it must be shaken before use to completely suspend the molybdenum disulfide. The composition is applied and the solvent allowed to evaporate. No other processing is required. The molybdate bonds to the metal surface and the molybdenum disulfide adheres to the molybdate to form a dry combined surface coat that prevents corrosion, galling and the like and lubricates working parts and the bore of the weapon for reduced friction of the projectile. This reduces heat, increases ballistic speed and accuracy and prevents build up of harmful deposits broken off from the projectile or broken down by heat degradation of organic binders as found in compositions of the prior art. Repetitive firings after so treating the bore shown much less build up of lead deposits. Consequently, the number of firings before cleaning is necessary can be greatly increased.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the inventioin may be made within the underlying idea or principles of the invention within the scope of the appended claims.

I claim:

1. A composition for surface treatment of firearms and bullets, comprising:

a) finely divided molybdenum disulfide, between 20 and 0.01 percent by weight;

b) alkali metal molybdate, between 5 and 0.01 percent by weight;

c) volatile organic solvent, between 99.9 and 75 percent by weight.

2. The composition according to claim 1 in which said volatile organic solvent is substantially a halogenated hydrocarbon.

3. The composition according to claim 2 in which said halogenated hydrocarbon is trichloroethane.

4. A compositoin for treatment of firearms and bullets, comprising:

a) finely divided molybdenum disulfide, between about 5 and 0.1 percent by weight;

b) alkali metal molybdate, between 5 and 0.01 percent by weight;

c) volatile organic solvent, between about 96 and 99.89 percent by weight.

5. The composition according to claim 4 in which said volatile organic solvent is substantially a halogenated hydrocarbon.

6. The composition according to claim 5 in which said halogenated hydrocarbon is trichlorothane.

* * * * *